US005988462A

United States Patent [19]

Kolton

[11] Patent Number: 5,988,462

[45] Date of Patent: Nov. 23, 1999

[54] SECURITY GARMENT HANGER

[75] Inventor: Chester Kolton, Westfield, N.J.

[73] Assignee: B&G Plastics, Inc., Newark, N.J.

[21] Appl. No.: 09/174,727

[22] Filed: Oct. 19, 1998

[51] Int. Cl.[6] ..... A47G 25/14

[52] U.S. Cl. ..... 223/85; 223/87

[58] Field of Search ..... 223/85, 92, 87, 223/95, 86, DIG. 4; 70/57.1

[56] References Cited

U.S. PATENT DOCUMENTS

| | | | |
|---|---|---|---|
| 3,241,732 | 3/1966 | Combi | 223/86 |
| 5,423,139 | 6/1995 | Feldman | 40/299 |
| 5,524,463 | 6/1996 | Schenkel et al. | 70/57.1 |
| 5,615,810 | 4/1997 | Kolton et al. | 223/87 |
| 5,620,118 | 4/1997 | Kolton et al. | 223/87 |
| 5,626,268 | 5/1997 | Kolton et al. | 223/87 |

*Primary Examiner*—BIBHU MOHANTY
*Attorney, Agent, or Firm*—Robin, Blecker & Daley

[57] ABSTRACT

A garment hanger is comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS member.

19 Claims, 3 Drawing Sheets

SECURITY GARMENT HANGER

FIELD OF THE INVENTION

This invention relates generally to hangers for garments and pertains more particularly to hangers for enhanced retention of garments, such as ties, and having theft-deterrent capability.

BACKGROUND OF THE INVENTION

For purposes of indicating marketing parameters, e.g. manufacturer, price, size and the like, one current practice is to use a so-called "swift tag" involving a plastic filament which is passed through an opening in a tag bearing the marketing parameters and through a garment or the like and is then secured at filament ends to remain with the garment until the filament is cut apart at checkout.

One of applicant's fields of endeavor has been so-called "folding tail" hangers for the display of belts, ties and the like. Article identification data and logo are typically embossed on a main body portion of folding tail hangers. One such folding tail hanger is discussed and shown in U.S. Pat. No. 5,005,741. A characteristic of this type of hanger not found in prior folding tail hangers is that, when the tail is applied to an article and the tail projection inserted into the main body opening for latching the tail to the main body, a conical main body part extending rearwardly of the main body rear surface continues the opening and so retains the tail projection that tail is not separable from the main body without cutting activity. This type of hanger is accordingly referred to as a "security" hanger. A practice of one major retailer is to require all articles adapted to be hung by security hangers be so displayed.

A widespread practice in article security is the use of so-called anti-theft tags which incorporate electronic article surveillance (EAS) markers. Such tags are secured to articles and are removed or rendered inactive at checkout. Where fraudulent avoidance of checkout (shoplifting) occurs, the markers are sensed by EAS systems, e.g., at store exits, and suitable alarm is generated.

One form of RAS marker in widespread use is in the form of a flat, thin, flexible, rectangular member which is applied adhesively to flat or curved exterior surfaces of articles. One shortcoming of such exterior surface application is that, while often covered by a bar code label, the presence of the EAS marker nonetheless is evident since it is visible from the sides of the bar code label. Still further, the EAS marker is accessible to a customer.

SUMMARY OF THE INVENTION

The present invention has as its primary object the provision of a security hanger-having theft-deterrent capability.

A more particular object of the invention is to provide a security hanger having an EAS marker therewith and not visible to a customer.

In attaining the above and other objects, the present invention provides a garment hanger comprised of a one-piece body having a hook portion for the receipt of a display rod, a central portion depending from the hook portion and a lower portion for engagement with an article to be displayed. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS marker.

In a particularly preferred embodiment, the invention provides a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line segment depending from the central portion and a flap segment depending from the fold line segment, the central portion, the fold line segment and the flap segment jointly defining a slot in the body which opens into a margin of the body. The central portion defines a recess opening into an exterior surface of the central portion, the recess being of dimensions suited for residence of an EAS marker in the hanger. A bar code label or like recess closure member is affixed to the central portion exterior surface in contiguous overlying relation therewith and enclosing the resident EAS member.

The central portion and the flap segment define coactive means for retaining the flap segment against the central portion on folding of the flap segment about the fold line segment.

The fold line segment is disposed contiguously with an interior end of the slot and provides cantilever support for the flap segment.

The foregoing and other objects and features of the invention will be further evident from the following detailed description of preferred embodiments thereof and from the drawings in which like components are identified by like reference numerals throughout.

DETAILED DESCRIPTION OF THE PREFERRED EMBODIMENTS

Figure 2A:
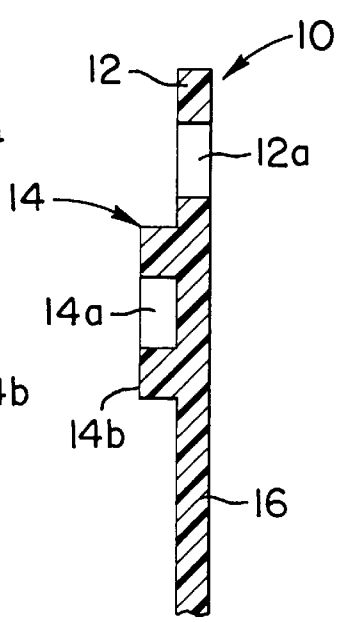
FIG. 2A is a sectional view of the FIG. 1 body as would be seen from plane IIA—IIA of FIG. 2.
Figure 2:
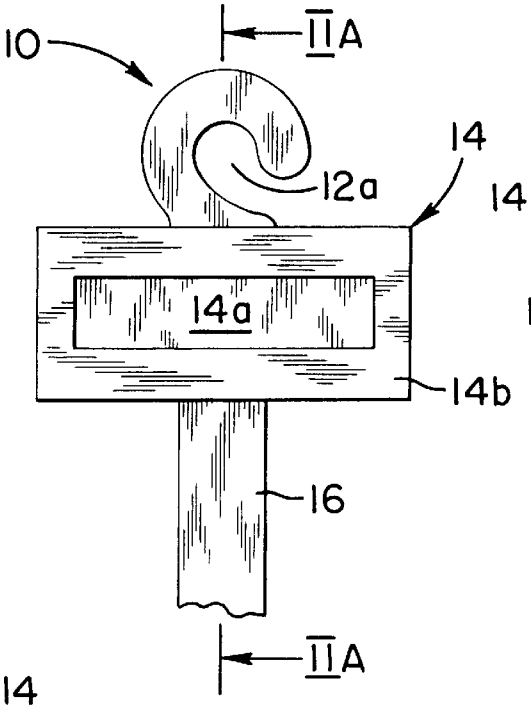
FIG. 2 is a rear elevation of the FIG. 1 body.
Figure 3:
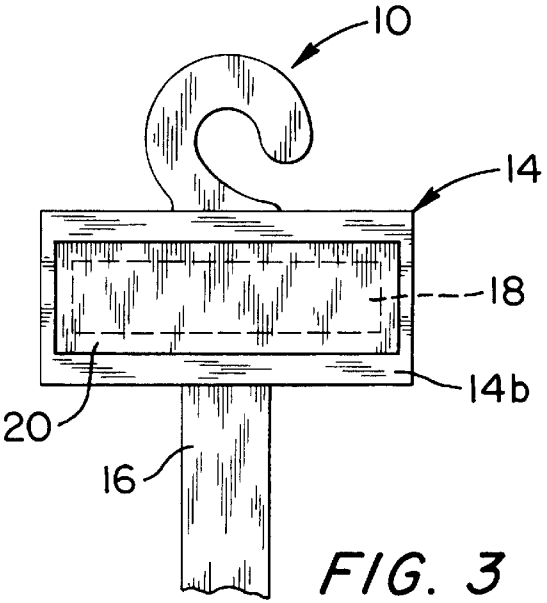
FIG. 3 is a front elevation of the first hanger embodiment.
Figure 1:
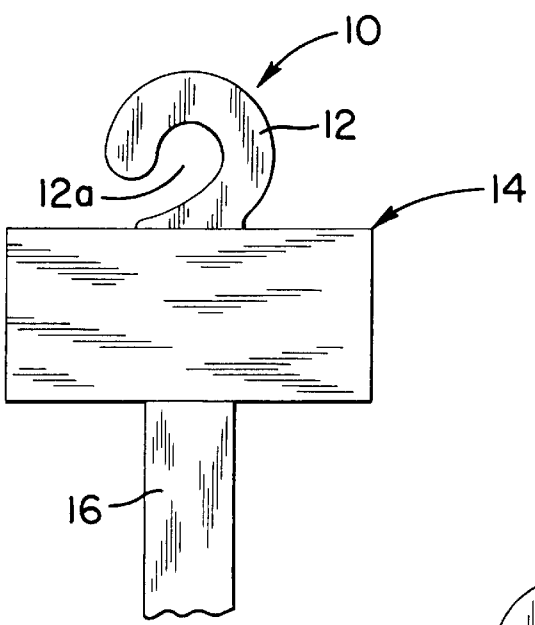
FIG. 1 is a front elevation of a one-piece body for a first embodiment of a hanger in accordance with the invention prior to assembly with an EAS member.

Referring to FIGS. 1–3, which depict a first embodiment of the invention, a garment hanger is comprised of a one-piece body 10, having a hook portion 12 with an opening 12*a* for the receipt of a display rod, a central portion 14 depending from the hook portion and a lower portion 16 for engagement with an article to be displayed. Central portion 14 defines a recess 14*a* opening into an exterior surface 14*b* of the central portion, the recess being of dimensions suited for residence of an EAS marker 18 in the hanger.

In the assembled hanger, shown in FIG. 3, EAS marker 18 is resident in recess 14*a* and a bar code label or like recess closure member 20 is affixed to the central portion exterior surface 14*b* in contiguous overlying relation with and enclosing the resident EAS marker 18.

Figure 6:
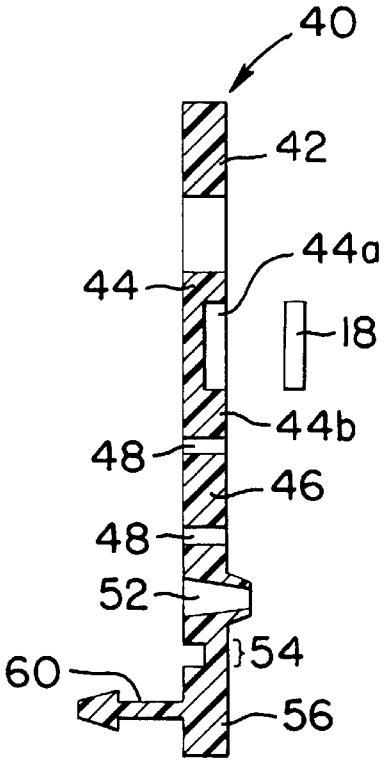
FIG. 6 is a cross-sectional view of the FIG. 4 body as would be seen from plane VI—VI of FIG. 4 and also showing an EAS marker.
Figure 4:
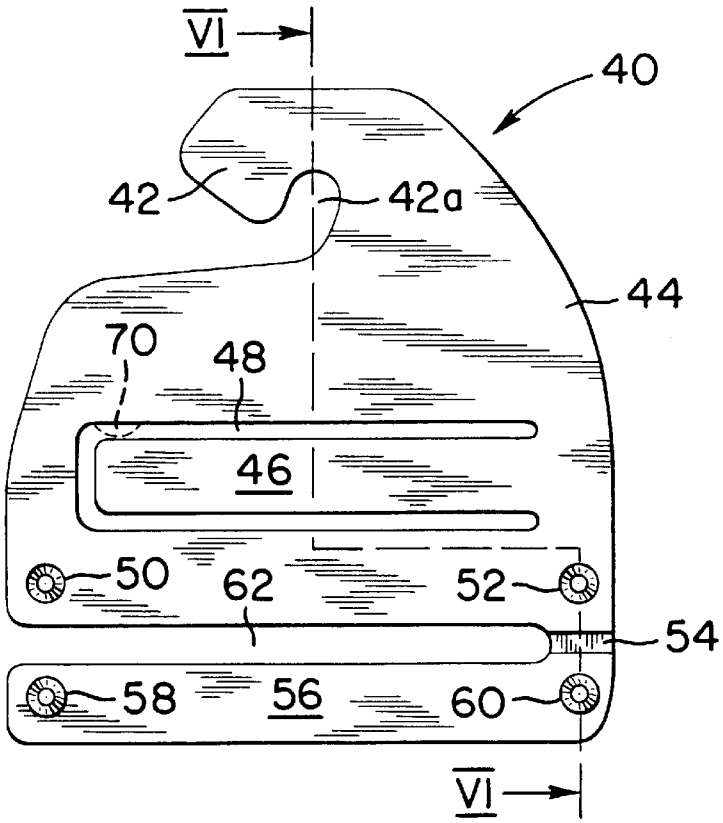
FIG. 4 is a front elevation of a one-piece body for a second embodiment of a hanger in accordance with the invention prior to assembly with an EAS member.
Figure 5:
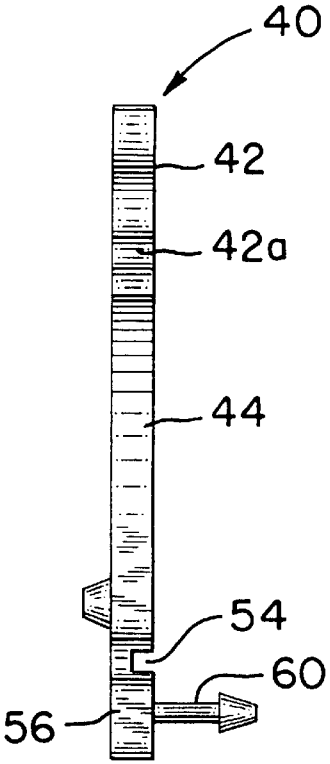
FIG. 5 is a left side elevation of the FIG. 4 body.

Referring to FIGS. 4–6, a second embodiment garment hanger is comprised of a one-piece synthetic plastic body 40 having a hook portion 42 with an opening 42*a* for the receipt of a display rod. A central portion 44 of hanger body 40 depends from hook portion 42 and has a garment support member 46 disposed in opening 48 and cantilever-supported by the central portion. The central portion also includes latching openings 50 and 52 adjacent respective lateral margins thereof.

A lower portion of hanger body 40 has a fold line segment 54, depending from the central portion, constituted by thinning out the one-piece body to have a lesser thickness in fold line segment 54, and a flap segment, depending from the fold line segment and including a panel 56 with latching projections 58 and 60.

The latching openings and projections constitute coactive structure for retaining the flap segment against the central portion on folding of the flap segment about the fold line segment. While the hanger may be constructed such that the retention is releasable, it is preferred that the retention not be releasable and that cutting is required to remove a hung garment from the hanger. Incorporating reference is made in this respect to commonly-owned U.S. Pat. No. 5,005,741, which describes in detail the non-releasable projections and latching recess structure shown in FIGS. 4–6.

The hanger central portion, the fold line segment and the flap segment jointly define slot 62, which has an interior end with which the fold line segment is contiguous and opens into the left side margin of hanger 40. The fold line segment provides cantilever support for the flap segment.

Central portion 44 defines a recess 44*a* opening into an exterior surface 44*b* of the central portion, the recess being of dimensions suited for residence of EAS marker 18 in the hanger.

Figure 7:
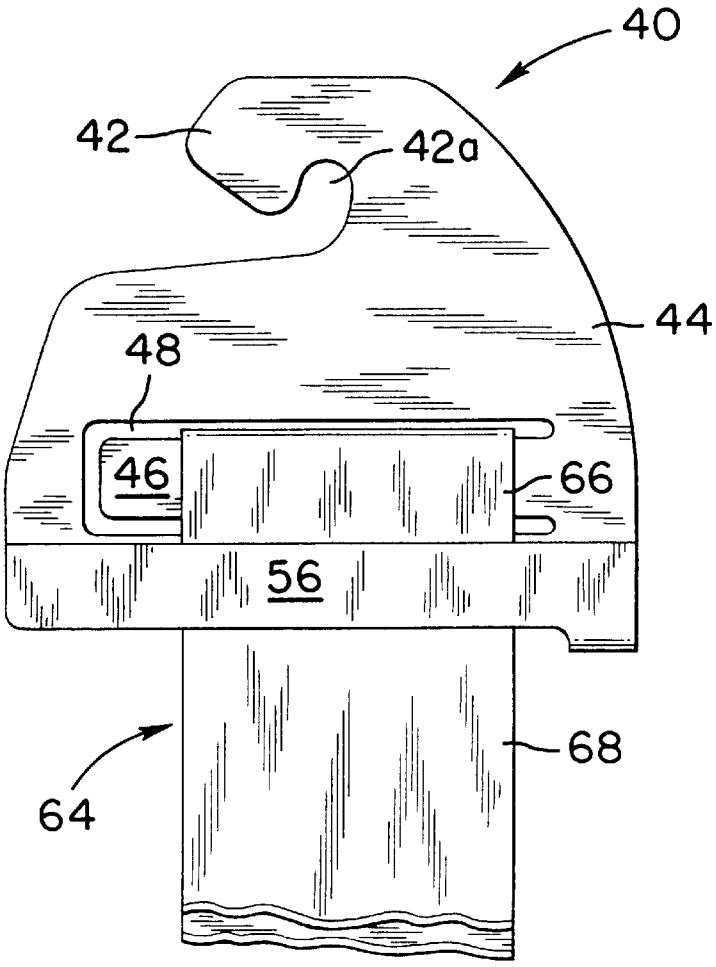
FIG. 7 is a front elevational view of the hanger second embodiment assembled with a tie.
Figure 8:
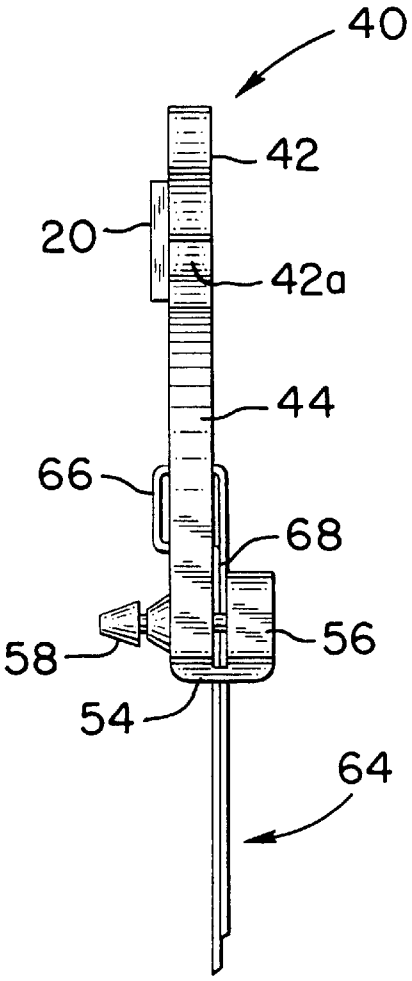
FIG. 8 is a left side elevational view of the FIG. 7 assembly.

In the assembled hanger, shown in FIGS. 7 and 8, EAS marker 18 is resident in recess 44*a* and a bar code label or like recess closure member 20 is affixed to the central portion exterior surface 44*b* in contiguous overlying relation with and enclosing the resident EAS marker 18.

In FIGS. 7 and 8, the hanger is also shown in assembly with tie 64, the tie having a first part 66 looped about support member 46 and a second part 68 extending through slot 66 and disposed between the central portion and the flap segment.

In reaching the assembly of FIGS. 7 and 8, an assembler forms a tie with looped first part 66 and displaces both support member 46 and panel 52 outwardly of the plane of the hanger body, e.g., rearwardly of the plane of FIG. 4. The looped first part 66 is then dressed over and about support member 46 and the second part 68 is then inserted into slot 62. panel 52 is then folded about the fold line segment and projections 58 and 60 are forced into openings 50 and 52.

In either embodiment, the hanger central portion may include plural, separate recesses where the EAS marker and a component, e.g., a semiconductor chip, associated therewith are to be accommodated.

The referenced, commercially-used EAS marker comprises a ferromagnetic member. The hanger bodies are is thus comprised of a material which permits detection of the EAS marker as is the closure members. With the closure members in place, it will be appreciated that hangers of the invention do not evidence that they have EAS-anti-shoplifting characteristics.

Various changes may be introduced in the disclosed preferred embodiments without departing from the invention. For example, while the recesses are shown to open into rear surfaces of the hanger bodies, and are closed by bar code labels, the recesses may open into front surfaces of the hanger bodies, and may be closed by logo bearing labels.

What is claimed is:

1. A garment hanger comprised of a one-piece body having a hook portion for the receipt of a display rod, a central portion depending from the hook portion and a lower portion for engagement with an article to be displayed, the central portion defining a recess opening into an exterior surface of the central portion, an EAS marker resident in said recess, and a recess closure member affixed to the central portion exterior surface in contiguous overlying relation therewith and enclosing the resident EAS member.

2. The hanger claimed in claim 1, wherein said recess closure member bears a bar code on an exterior surface thereof.

3. The hanger claimed in claim 1, wherein said recess closure member bears a logo on an exterior surface thereof.

4. A garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which opens into a margin of said body, the central portion defining a recess opening into an exterior surface of the central portion, an EAS marker resident in said recess, and a recess closure member affixed to the central portion exterior surface in contiguous overlying relation therewith and enclosing the resident EAS member.

5. The hanger claimed in claim 4, wherein said recess closure member bears a bar code on an exterior surface thereof.

6. The hanger claimed in claim 4, wherein said recess closure member bears a logo on an exterior surface thereof.

7. The hanger claimed in claim 4, wherein said central portion and said flap segment define coactive means for retaining said flap segment against said central portion on folding of said flap segment about said fold line segment.

8. The hanger claimed in claim 4, wherein said fold line segment is contiguous with an interior end of said slot and provides cantilever support for said flap segment.

9. The garment hanger claimed in claim 7, wherein said coactive means is comprised of at least one projection on said flap segment and at least one latching opening in said central portion.

10. The garment hanger claimed in claim 7, wherein said coactive means is comprised of first and second projections on said flap segment adjacent respective lateral margins thereof and first and second latching openings in said central portion adjacent respective lateral margins thereof.

11. In combination:

(a) a garment hanger comprised of a one-piece body having a hook portion for the receipt of a display rod, a central portion depending from said hook portion, said body defining in said central portion an opening therethrough and a garment support member disposed in said opening and movable relative to said body and a lower portion defining a fold line segment depending from said central portion and a flap segment depending from said fold line segment, said central portion, said fold line segment and said flap segment jointly defining a slot in said body which opens into a margin of said body, the central portion defining a recess opening into an exterior surface of the central portion, an EAS marker resident in said recess, and a recess closure member affixed to the central portion exterior surface in contiguous overlying relation therewith and enclosing the resident EAS member; and (b) a garment having a first part looped about said garment support member and a second part extending through said slot, said garment second part being disposed between said central portion and said flap segment.

12. The invention claimed in claim 11, wherein said central portion and said flap segment define coactive means for retaining said flap segment against said central portion on folding of said flap segment about said fold line segment.

13. The invention claimed in claim 11, wherein said fold line segment is contiguous with an interior end of said slot and provides cantilever support for said flap segment.

14. The invention claimed in claim 12, wherein said coactive means is comprised of at least one projection on said flap segment and at least one latching opening in said central portion.

15. The invention claimed in claim 13, wherein said coactive means is comprised of first and second projections on said flap segment adjacent respective lateral margins thereof and first and second latching openings in said central portion adjacent respective lateral margins thereof.

16. A garment hanger comprised of a one-piece body having a hook portion for the receipt of a display rod, the body defining a recess opening into an exterior surface of the body, an EAS marker resident in said recess, and a recess closure member affixed to the body exterior surface in contiguous overlying relation therewith and enclosing the resident EAS member.

17. The hanger claimed in claim 16, wherein said body defines a central body portion depending from said hook portion, wherein said recess opens into an exterior surface of said central portion and wherein said recess closure member is affixed to the central portion exterior surface in contiguous overlying relation therewith and enclosing the resident EAS member.

18. The hanger claimed in claim 16, wherein said recess closure member bears a bar code on an exterior surface thereof.

19. The hanger claimed in claim 16, wherein said recess closure member bears a logo on an exterior surface thereof.

* * * * *

UNITED STATES PATENT AND TRADEMARK OFFICE

CERTIFICATE OF CORRECTION

PATENT NO. : 5,988,462

DATED : November 23, 1999

INVENTOR(S) : Chester Kolton

It is certified that error appears in the above-identified patent and that said Letters Patent is hereby corrected as shown below:

Col. 1, line 41, delete "RAS" and insert – EAS –.

Signed and Sealed this

Tenth Day of April, 2001

*Attest:*

Nicholas P. Godici

NICHOLAS P. GODICI

*Attesting Officer*

*Acting Director of the United States Patent and Trademark Office*